United States Patent [19]

Giolitti

[11] 4,427,313

[45] Jan. 24, 1984

[54] RIBBON CARTRIDGE FOR A TYPEWRITER

[75] Inventor: Nicolo Giolitti, Ivrea, Italy

[73] Assignee: Remington Ind. E. Com. de Sistemas para Escritorio S. A., Rio de Janiero, Brazil

[21] Appl. No.: 366,565

[22] Filed: Apr. 8, 1982

[30] Foreign Application Priority Data

Apr. 27, 1981 [IT] Italy ..... 53179/81[U]

[51] Int. Cl.[3] ..... B41J 35/28; B41J 32/00

[52] U.S. Cl. ..... 400/208; 400/236.1; 400/697.1

[58] Field of Search ..... 400/697.1, 208, 236, 400/236.1, 235.1, 214

[56] References Cited

U.S. PATENT DOCUMENTS

| | | | |
|---|---|---|---|
| 1,338,699 | 5/1920 | Roberts | 400/236.1 |
| 3,833,108 | 9/1974 | Van Daeniken | 400/208 |
| 3,877,561 | 4/1975 | Guerrini et al. | 400/235.1 |
| 3,905,465 | 9/1975 | Frechette et al. | 400/214 |
| 4,033,445 | 7/1977 | Oddicini | 400/235.1 |
| 4,071,134 | 1/1978 | Humphrey | 400/697.1 |
| 4,268,181 | 5/1981 | Decker | 400/214 |
| 4,302,118 | 11/1981 | Schaefer | 400/208 |
| 4,329,072 | 5/1982 | Kacmarcik | 400/697.1 |
| 4,367,963 | 1/1983 | Daughters | 400/208 |

FOREIGN PATENT DOCUMENTS

| | | | |
|---|---|---|---|
| 56-69189 | 6/1981 | Japan | 400/697.1 |

*Primary Examiner*—William Pieprz

*Attorney, Agent, or Firm*—Michael N. Meller

[57] ABSTRACT

A typewriter ribbon cartridge for a typewriter with a correction key, in which a support body has a first and a second volume opposite one another and separated by a back wall integral with the body and able to house, respectively, a typewriter ribbon and a correction ribbon for the typewriter ribbon, the chambers being provided with means for guiding the ribbons through a window of the said body.

8 Claims, 7 Drawing Figures

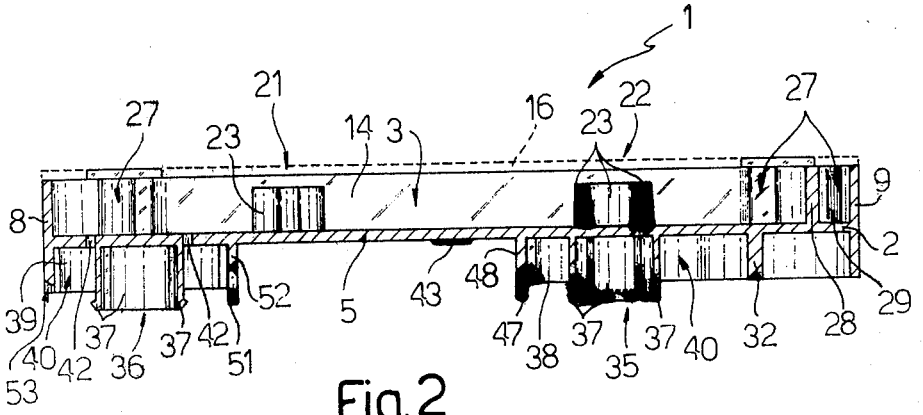
Fig. 2
Fig. 1
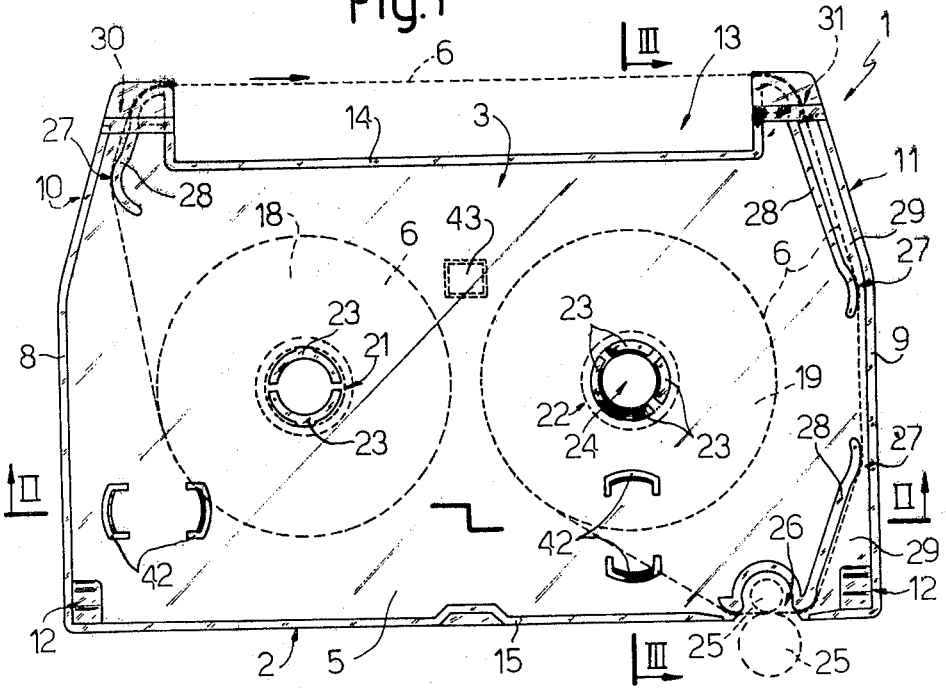

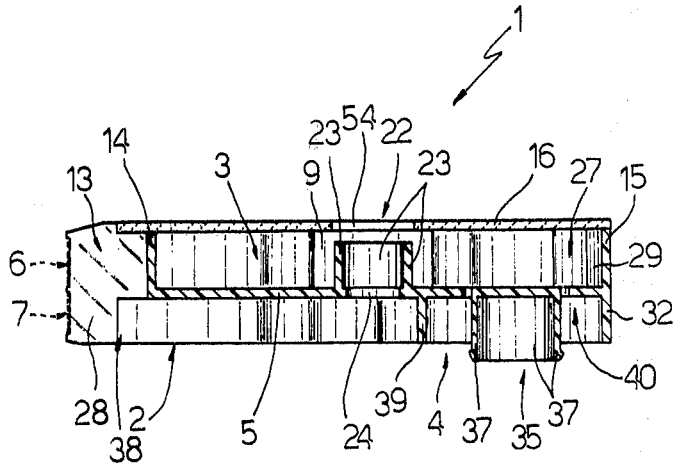
Fig.3
Fig.7
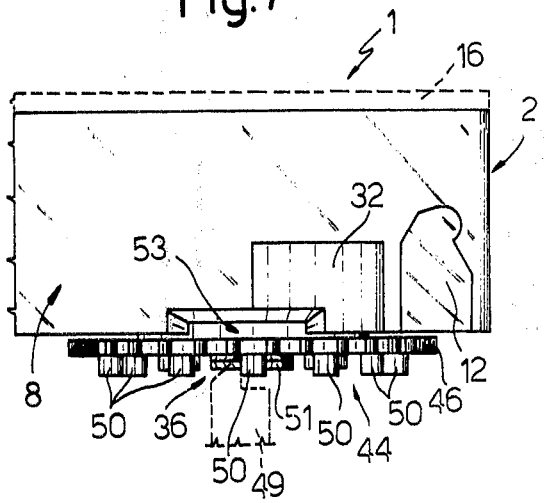

RIBBON CARTRIDGE FOR A TYPEWRITER

BACKGROUND OF THE INVENTION

The present invention relates to a ribbon cartridge for a typewriter having a correction key.

It is known that typewriters having a correction key are provided with two independent ribbons, one for the typewriting and one for the cancellation, which is obtained by enabling the machine by means of the correction key and then pressing the key corresponding to the erroneously typed symbol. In the majority of cases the typewriter ribbon is of the synthetic plastics film type and therefore typing is effected by depositing a portion of this plastics film on the sheet to be typed, by the operation of the type bars on which the various symbols are engraved, which press the plastics film against the sheet to by typed leaving a portion which remains adhering to the sheet. Cancellation is effected with correction ribbons having adhesive properties in relation to these plastics films and which therefore achieve separation of the incorrect symbol from the sheet being typed by causing it to adhere to its adhesive surface. In known constructions the typewriter ribbon and correction ribbon are made separately and are mounted on the typewriter independently from one another. In particular, the typewriter ribbons are contained in suitable sealed typewriter ribbon cartridges whilst the correction ribbons are directly mounted by an operator onto the typewriter and are replaced periodically or when worn out.

The arrangement described is not free from disadvantages. In particular, each type of plastics film typewriter ribbon requires a particular correction ribbon which does not work (or works poorly) with typewriter ribbons of different type. Since correction ribbon and typewriter ribbon are produced, sold and mounted separately it is often not possible to provide the appropriate correction ribbon for the particular typewriter ribbon utilised, and therefore the possibility of a simple correction of a typing error offered by a machine with a correction key is entirely or partly lost. Moreover the fitting and/or replacement of the correction ribbon, which does not have a modular cartridge, is often complex and difficult and sometimes also requires the removal of the typewriter ribbon cartridge. Finally, if the typewriter ribbon is replaced with a ribbon of different type it is necessary also to replace the correction ribbon thereby performing a further operation.

SUMMARY OF THE INVENTION

The object of the present invention is to provide a typewriter ribbon cartridge for typewriters provided with a correction key, which is able to effect both the typewriting operations and the correction and cancellation operations.

The said object is achieved with the present invention in that it relates to a typewriter ribbon cartridge for typewriters provided with a correction key, comprising a substantially flat support body provided with a first sealable chamber which can contain a typewriter ribbon for the said typewriter, the said first volume having a first pair of spool pivots for the said typewriter ribbon and first means for guiding this latter along a window of the said body and being able to house a first mechanism of the said typewriter for winding on the said typewriter ribbon, characterised by the fact that the said body is provided with at least one second volume opposite the said first volume and separated from it by means of a back wall integrally formed with the said body, the said second volume being able to contain a correction ribbon for the said typewriter ribbon and being provided with a device for the control of the said correction ribbon which can be operated by a second mechanism of the said typewriter, and second means for guiding the said correction ribbon through the said window.

BRIEF DESCRIPTION OF THE DRAWINGS

For a better understanding of the present invention there is now given a description of an embodiment thereof which reference to the attached drawings, in which:

FIG. 1 is a plan view from above of a typewriter ribbon cartridge formed according to the principles of the present invention;

FIG. 2 is a section through the cartridge of FIG. 1 taken on the line II—II;

FIG. 3 is a section through the cartridge taken on the line III—III of FIG. 1;

FIG. 7 illustrates, on an enlarged scale, a portion of the side view of FIG. 5.

DETAILED DESCRIPTION OF THE INVENTION

Figure 4:
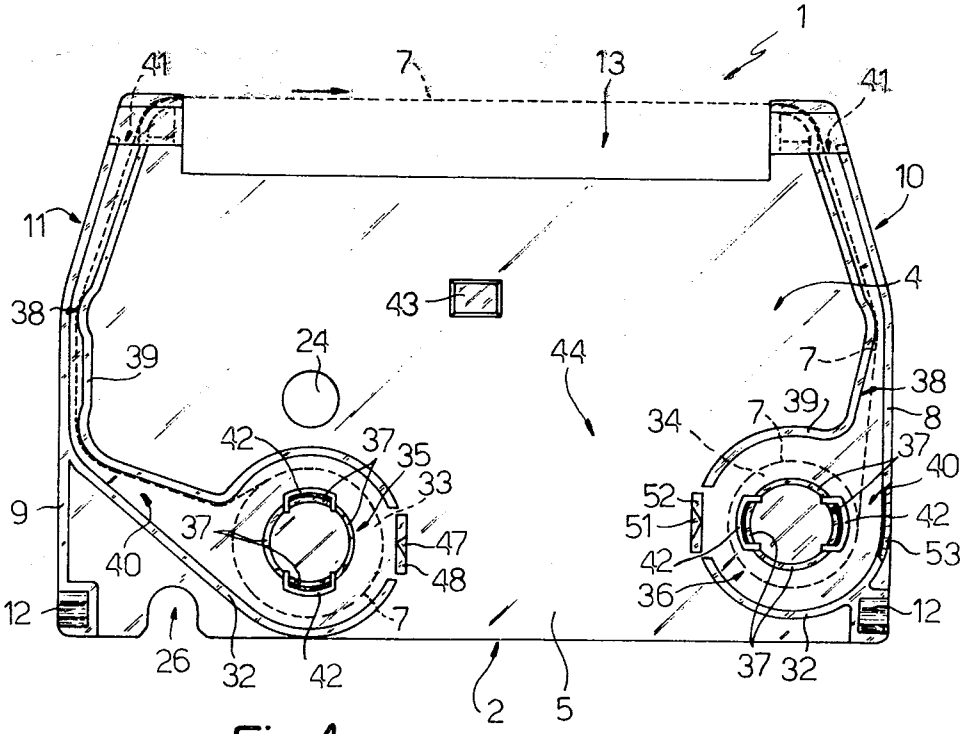
FIG. 4 is a plan view from below of the cartridge of FIG. 1.

With reference to FIGS. 1, 2, 3 and 4 a typewriter ribbon cartridge for a typewriter (not illustrated) provided with a correction key is generally indicated 1. The cartridge 1 includes a support body 2 sub-divided into two oppositely facing volumes 3 and 4 by a back wall 5 integrally formed with the body 1, a typewriter ribbon 6 indicated with a broken line, contained in the volume 3 and a correction ribbon 7, also indicated with a broken line, contained in the volume 4. The support body 2 is substantially flat and parallelepiped and has side walls 8 and 9 opposite one another and substantially perpendicular to the wall 5 so as to delimit two flanges projecting from it both upwardly and downwardly. The walls 8 and 9 have, respectively a first section 10 and a second section 11 inclined with respect to one another and converging towards the adjacent side of the cartridge, and recesses 12 for receiving support pins (not illustrated) of the said typewriter. The body 2 also has a rectangular window 13 formed in the edge of the wall 5 and delimited with respect to the volume 3 by a wall 14 substantially perpendicular to the walls 8 and 9.

The volume 3 is completely closed by the walls 8,9, 14 and by a wall 15 parallel to the wall 14, and can be sealed by means of a cover 16, preferably transparent, indicated in FIG. 2 with a broken line, and which can be fixed in any convenient manner, for example by gluing onto the upper edges of the said walls 8, 9, 14 and 15. Within the volume 3 there is contained the ribbon 6 the ends of which are wound onto spools 18 and 19 about two substantially cylindrical winding posts 21 and 22 constituted by a plurality of arcuate flexible tongues 23 integrally formed with the wall 5 and perpendicular thereto. The body 2 (therefore also the tongues 23) is preferably made of a resilient synthetic plastics material such as, for example, ABS (acrylonitrile butadiene styrene). In correspondence with the post 22 there is formed in the wall 5 a circular hole 24 to allow the passage of a mechanism of the typewriter (not illustrated) for winding the ribbon 6; this mechanism is of a known type and therefore is not described. The ribbon 6 advances in the direction of the arrows of FIG. 1 under the action of a transparent mechanism of the machine constituted by two counter rotating rollers 25, one of which is lodged in a semi-circular recess 26 formed in the wall 5 in correspondence with an open section of the wall 15. The winding mechanism serves to take up the ribbon 6 drawn by the rollers 25 from the spool 18 and to wind it onto the spool 19. The ribbon 6 is guided along its path by guide means 27 constituted by the surfaces of shaped side walls 28 within the volume 3 and substantially parallel to the inclined sides 10 and 11 in such a way as to form with these latter and with the wall 9 a channel 29 in which the ribbon 6 slides. The ribbon 6 passes out from the volume 3 through a slot 30 and enters the channel 29 through a slot 31 after having traversed the window 13 parallel to the wall 14 in such a way that it can be reached by the type bars of the typewriter during its path along the window 13.

The volume 4 is delimited by the wall 5, by the lower parts of the side walls 8 and 9 and by curved walls 32 integral with the walls 8 and 9 respectively; since the walls 14 and 15 do not extend below the bottom wall 5 the volume 4 is therefore open to the outside. The correction ribbon 7 is contained in the volume 4 and the ends of this ribbon are wound on two spools 33 and 34 respectively about posts 35 and 36 formed of resilient tongues 37 integral with the wall 5 with respect to which they are perpendicular. The ribbon 7 moves in the direction of the arrow in FIG. 4 in a sense opposite to the ribbon 6 and is guided by guide means 38 constituted by the surfaces of shaped walls 39 facing the side walls 8 and 9, and by the curved walls 32 in such a way as to form a duct 40 in which the ribbon 7 slides. It extends from this duct through slits 41 adjacent the window 13 parallel to the ribbon 6. The posts 35 and 36 are made particularly deformable by curved cut outs 42 formed in the wall 5, on which there is also formed a raised portion 43 on which acts a piston, not illustrated, controlled by the correction key, which selects the ribbon 6 or the ribbon 7 for use.

Figure 5:
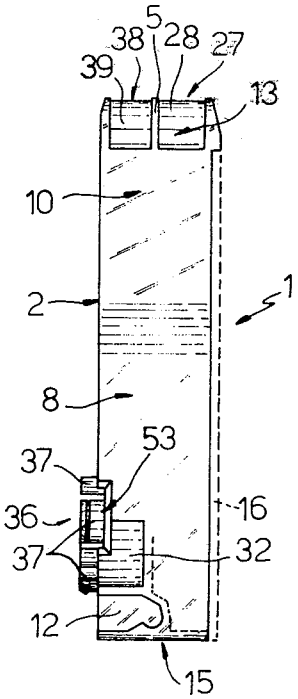
FIG. 5 is a side view of the cartridge of FIG. 1.
Figure 6:
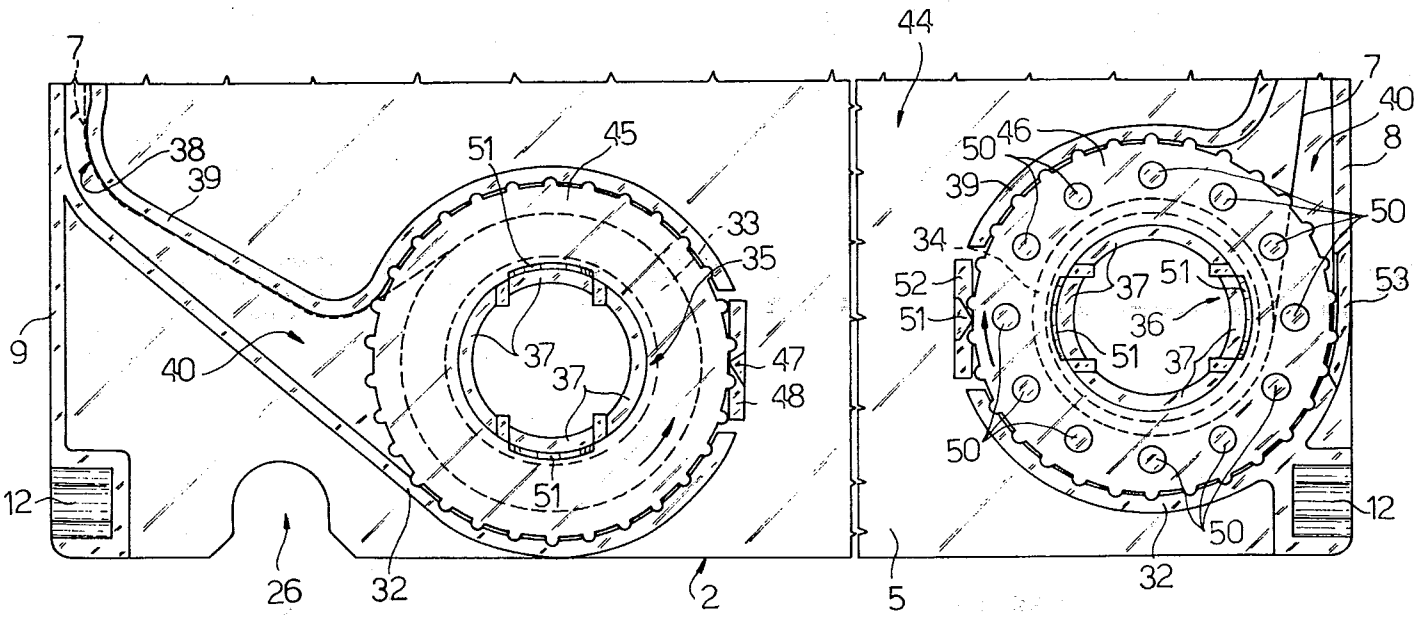
FIG. 6 illustrates, on an enlarged scale, a part of the plan view of FIG. 4.

With reference also to FIGS. 5, 6 and 7, the ribbon 6 is controlled by a device 44 including two toothed discs 45 and 46 freely rotatably mounted on the pivot posts 35 and 36 respectively outside the volume 4 in such a way as to enclose the spools 33 and 34 in the end regions of the ducts 40. The disc 45 turns together with the spool 33 in the direction of the arrow of FIG. 6, but cannot rotate in the opposite direction because it meshes with a shaped tooth 47 formed at the top of a flexible tongue 48 integral with the wall 5 with respect to which it is perpendicular, which, by deforming, permits only movement in the direction of the arrow but not in the opposite direction. The disc 46, on the other hand, turns together with the spool 34 in the direction of the arrow under the action of a known mechanism 49 (FIG. 7) of the typewriter, which is substantially a ratchet gear which can engage with studs 50 formed integrally on the disc 46 perpendicularly thereto and externally of the volume 4. The disc 46 engages, moreover, with a positioning tooth 51 formed at the top of a flexible tongue 52 integral with the wall 5 and parallel to the tongue 48 and can be also operated manually by introducing a finger through a suitable window 53 formed in the wall 8. In the event of jamming the spindle 19 can also be wound manually with a finger, by means of a hole 54 formed in the cover 16.

The operation of the cartridge described is as follows. The cartridge 1 containing the spool of typewriter ribbon 6 and the appropriate correction ribbon 7 is introduced by means of a simple operation into the typewriter by making the recesses 12 engage with suitable support pins. In this way the advancing mechanism 25 is located in correspondence with the seat 26 and the mechanism 49 for the studs 50, and the typewriter ribbon winding mechanism engages in the hole 24. The rollers 25 make the ribbon 6 advance in the direction of the arrow of FIG. 1 unwinding the spool 18 to form the spool 19 of used ribbon. To obtain a correction the machine is enabled by means of the correction key which causes the piston connected to the raised portion 43 to rise making the body 2 turn about the pins in the recesses 12 in such a way as to bring the section of the ribbon 7 which traverses the window 13, instead of the corresponding section of ribbon 6 parallel to it, selectively into the same position in the path of the type bars, and simultaneously operating the mechanism 49. The ribbon 7 advances under the pull of the disc 46 unwinding the spool 33. In the event of jamming it is possible to turn both the spool 19 and the spool 34 manually thanks to the hole 54 and the slot 53. If the corrector ribbon 7 is used up before the end of the ribbon 6 it can be replaced with a simple operation by removing the cartridge 1 and then, thanks to the deformable pins 35 and 36, extracting the gears 45 and 46 thereby gaining access to the ribbon 7. If, on the other hand, the more expensive ribbon 6 finishes first the entire cartridge has to be replaced.

From what has been described the advantages of the cartridge according to the invention will be apparent. In particular, it effectively couples the typewriter ribbon with a suitable correction ribbon thereby avoiding errors in mounting and allows a suitable correction ribbon always to be available together with the typewriter ribbon. Moreover the operation for replacement of the ribbons are very simple in that both are contained in the same modular cartridge which can be simply fitted. Finally, in the event of the correction ribbon being used up before the typewriter ribbon the cartridge according to the invention allows the replacement of the former with a simple operation which can be performed away from the typewriter, directly on the cartridge and not, as with known ribbons, on the typewriter itself where it is diffcult to gain access to the correction ribbon.

From what has been described it will also be clear that modifications and variations to the cartridge according to the present invention can be introduced without departing from the scope of the invention itself. In particular the form, structure, dimensions and nature of the ribbon guide means can be varied whilst the principle of the invention remains the same.

I claim:

1. A typewriter ribbon cartridge for a correcting typewriter having a means for advancing a correction ribbon, comprising:

(a) a housing defining first and second overlying volumes for containing a typewriter ribbon and a correction ribbon, respectively and an aperture which exposes a working length of the typewriter and correction ribbons, said first and second volumes being configured to support said typewriter and correction ribbons in overlying relationship to each other, said housing comprising:

(i) a bottom wall, positioned in said housing and rigidly positioned with respect to said housing at a position to separate said first and second volumes;

(ii) a first pair of sidewalls secured to said bottom wall in opposed relationship to each other, to define said first and second volumes, said second volume communicating with the outside, and said first sidewalls being positioned, configured and dimensioned to allow easy access to said second volume by a human operator, said first sidewalls being integral with said bottom wall, and said first volume being defined by the upper portion of said first sidewalls; and (iii) a cover rigidly secured to the upper edges of said first sidewall to close said first volume;

(b) a typewriter ribbon contained within said first volume;

(c) first guiding means for guiding said typewritten ribbon through said aperture;

(d) second guiding means for guiding the correction ribbon disposed within said second volume;

(e) a pair of winding posts for supporting said correction ribbon;

(f) a winding mechanism, external to said second volume and for engaging said means for advancing the correction ribbon for closing at least a portion of said second volume; and (g) said winding means including two toothed discs each of which is freely and rotatably mounted on one of said posts.

2. A cartridge as in claim 1, wherein said second volume containing said correction ribbon is defined by two opposing shaped walls substantially parallel with and facing said first sidewalls, by said first sidewalls, and by two curved walls integral with said first sidewalls and extending below said bottom wall and perpendicular thereto.

3. A typewriter ribbon cartridge according to claim 2, wherein said winding mechanism further comprises abutment teeth formed on the ends of flexible tongues extending below said bottom wall and perpendicular thereto, and operable to engage said discs, and a plurality of studs formed on one of said discs, which studs are engageable by said means for advancing the correction ribbon on said machine; said correction ribbon being wound on spools said spools being rigid with said discs and said flexible tongues and said winding posts are integral with said body.

4. A typewriter ribbon cartridge according to claim 2, wherein said first guiding means comprises the surfaces of first shaped walls formed within said first volume in positions facing the sidewalls of said first pair, in such a way as to create a first duct within which said typewriter ribbon may slide.

5. A typewriter ribbon cartridge according to claim 2, wherein said second guiding means are constituted by surfaces of said two opposite shaped walls.

6. A typewriter ribbon cartridge according to claim 2, wherein said housing has recesses for housing support pins of the typewriter about which said housing can turn in such a way as to bring a section of said typewriter ribbon or correction ribbon which traverses said aperture selectively into the same position.

7. A typewriter ribbon cartridge according to claim 2, wherein said body is made from a synthetic plastic resin.

8. A typewriter ribbon cartridge according to claim 3, wherein said winding posts are constituted by a plurality of flexible tongues integrally formed with said bottom wall.

* * * * *